United States Patent [19]

Remenicky

[11] Patent Number: 4,512,167

[45] Date of Patent: Apr. 23, 1985

[54] VARIABLE POSITION QUICK MOUNT COMBINATION LOCK

[75] Inventor: Joseph M. Remenicky, Nicholasville, Ky.

[73] Assignee: Sargent & Greenleaf, Inc., Nicholasville, Ky.

[21] Appl. No.: 520,681

[22] Filed: Aug. 4, 1983

[51] Int. Cl.[3] ..... E05B 9/00

[52] U.S. Cl. ..... 70/443; 70/303 A; 70/315; 70/329

[58] Field of Search ..... 70/302, 303 R, 303 A, 70/315, 316, 317, 318, 319, 320, 329, 442, 443, 448, 462

[56] References Cited

U.S. PATENT DOCUMENTS

| | | | |
|---|---|---|---|
| 3,038,325 | 6/1962 | Maynard | 70/443 |
| 3,196,643 | 7/1965 | Moss | 70/302 |
| 3,369,382 | 2/1968 | Russell | 70/315 |
| 3,436,941 | 4/1969 | Potzick | 70/317 |
| 3,968,667 | 7/1976 | Gartner | 70/303 A |
| 4,238,942 | 12/1980 | Parrock | 70/316 |

*Primary Examiner*—Robert L. Wolfe

*Attorney, Agent, or Firm*—Mason, Fenwick & Lawrence

[57] ABSTRACT

A quick mount combination lock constructed to be readily installed or changed to assume any of the four right hand, left hand, vertical up, or vertical down installation positions from externally of the lock case, wherein the lock case includes a front case section and a rear cover plate providing a lock mechanism chamber housing the usual tumbler wheels, a drive spindle extending from a dial, and a drive cam adjustably positioned on the spindle by a spline key at any of four angular positions correlated to said installation positions. The front case section has an integral flange extension protruding from an end wall of the case having a mounting screw opening, and the front case section and cover plate have aligned mounting screw holes extending entirely therethrough whereby the mounting screws for the lock case are accessible for installation and withdrawal without removing the cover plate from the front case section. The cover plate has an access opening concentric with the spindle axis for removal and installation of the spline key releasably retaining the driving cam in any of the four angular positions on the spindle, and a removable closure button member for the access opening.

18 Claims, 7 Drawing Figures

Fig-3
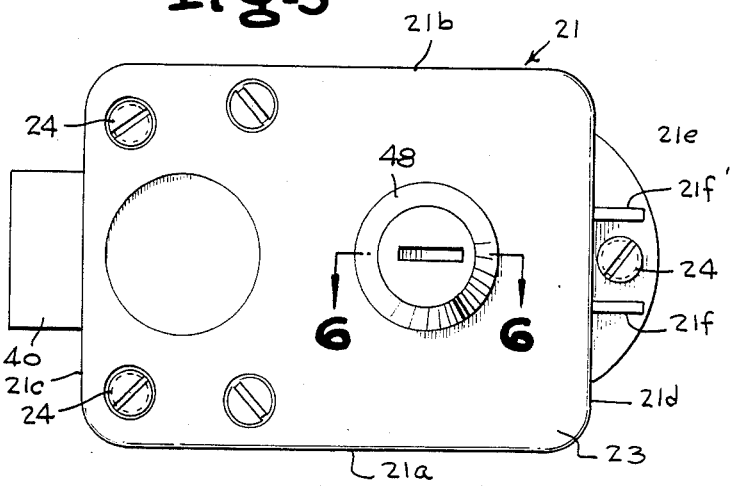
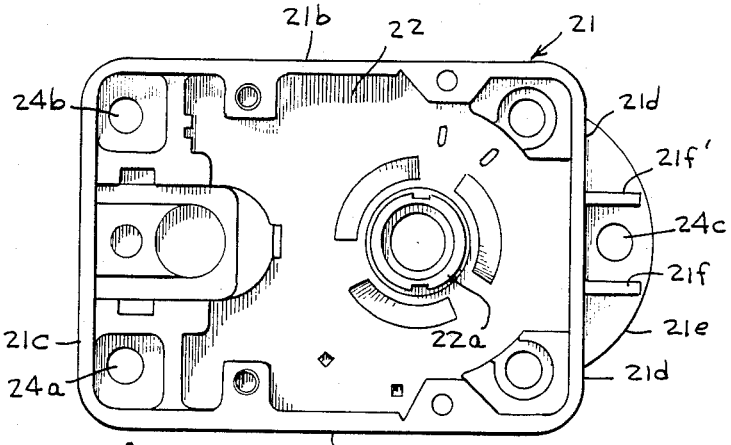
Fig-4
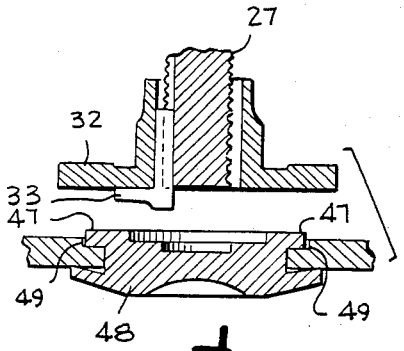
Fig-6
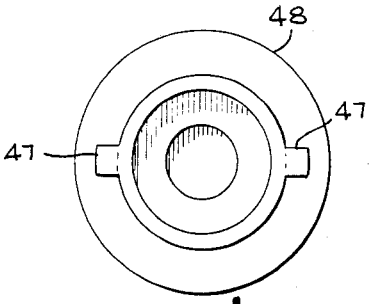
Fig-7
Fig-5
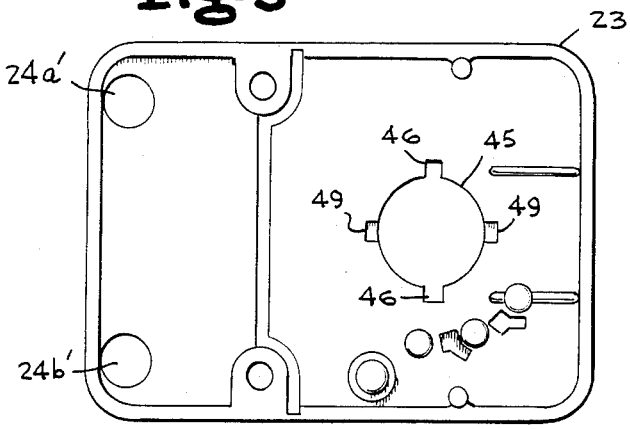

VARIABLE POSITION QUICK MOUNT COMBINATION LOCK

BACKGROUND AND OBJECTS OF THE INVENTION

The present invention relates in general to combination locks, and more particularly to combination locks of the gated tumbler wheel type operated by a dial with associated spindle and a driving cam, wherein the case and associated components facilitate installation in various positions, for example left or right hand positions, or vertical up or vertical down, without disassembling the lock.

Conventional locks of the class known as combination locks usually comprise three or four tumbler wheels which are loosely journaled in a coaxial, side-by-side spaced stack for rotation within a lock casing on a tubular arbor or tumbler post projecting inwardly from the front wall of the casing or from the rear cover plate. The lock dial, which usually has 100 peripheral calibration marks thereon, is affixed to a dial spindle which extends through the bore of the tumbler post and has keyed to the inner end thereof a disc-like drive cam which is likewise arranged coaxially with and spaced rearwardly from the stack of tumbler wheels. A drive pin projects forwardly from the drive cam and with a conventional fly rotatable through a limited arc and associated with the rearmost tumbler wheel, provides a lost motion coupling to drive the tumbler wheel in selected relation to the drive cam. A similar lost motion coupling is provided between each of the successive tumbler wheels so that each of the tumbler wheels may be driven upon predetermined rotation of the drive cam. A thin spacer washer is also customarily provided between each of the tumbler wheels. Each of the flies or fly members between the successive tumbler wheels and between the rearmost tumbler wheel and the drive cam typically comprise a ring portion journaled in concentric relation with the associated tumbler wheel and a radial projection which lies between a pair of stop shoulders disposed to abut portions of the radial projection and limit angular rotation of the fly to about 20° or other desired limited angular range. A drive pin or lug projects from the adjacent tumbler wheel into position to abut the radial projection of the fly and transmit rotation to the adjacent tumbler wheel after the fly has moved through its predetermined lost motion angular range. Each of the tumbler wheels and the drive cam is provided with a peripheral notch or gate at a selected radial position on the drive cam and tumblers.

A fence lever, which is pivotally connected near one end on a reciprocative bolt member slidably supported in the lock casing, is provided with a depending nose near the opposite or free end of the fence lever which is designed to ride upon the drive cam periphery, in conventional combination locks, and has a bar or fence projecting laterally from the fence lever in overlying relation to the peripheries of the tumbler wheels. The position of the fence in relation to the length of the fence lever nose is usually such that the fence is spaced slightly outwardly from the peripheries of the tumbler wheels when the fence lever nose is riding on the drive cam periphery, in which position an abutment shoulder formation on the top wall of the lock case is adjacent and in the retraction path of the free end of the fence lever preventing movement of the bolt and the fence lever pivoted thereto toward retracted or unlocked position. When the tumbler wheel and drive cam gates are aligned to receive the fence and fence lever nose, the free end of the fence drops to a lower position sufficient to pass beneath the abutment shoulder formation and allow the fence lever and bolt to move to retracted or unlocked position.

The combination lock is opened, in the case of such conventional combination lock structures, by rotation of the dial in a predetermined sequence in clockwise and counterclockwise directions through predetermined numbers of revolutions to a series of numerical positions indicated by alignment of numbers or indicia on the lock dial with a fixed index adjacent the lock dial periphery, to dial a predetermined series of combination numbers and thereby effect angular rotation of the plurality of tumbler wheels to positions which result in alignment of the tumbler wheel peripheral gates with the fence, and the dial is then rotated to bring the drive cam gate to a position registered with the fence lever nose to cause the fence lever nose and fence to drop into the gates whereupon further rotation of the dial through a partial revolution in a predetermined direction achieves retraction of the bolt.

An object of the present invention, therefore, is the provision of a novel combination lock construction, wherein the mounting screws, the drive cam-to-spindle connection and combination alignment can be readily achieved from outside of or externally of the lock case, permitting significant reduction in installation time for safe manufacturers or others concerned with mounting such locks on safe doors or closures.

Another object of the present invention is the provision of a novel combination lock construction as described in the immediately preceding paragraph, wherein means such as a removable plastic insert is provided on the rear cover plate at a position allowing access to the drive cam while the cover plate is still assembled in and closes the case, for purposes of attaching the drive cam to the spindle in different desired angular positions for fixing the position of the drive cam on the spindle.

Yet another object of the present invention is the provision of a novel combination lock construction as described in the immediately preceding paragraph, wherein the access insert member is removable by a predetermined rotation thereof with a change key or similar tool to enable repositioning of the drive cam on the spindle.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 3 is a rear elevation view of the lock case, with the rear cover assembled thereon;

FIG. 4 is a rear elevation view of the lock case, with all of the locking mechanism removed and the rear cover plate removed;

FIG. 5 is a elevation view of the rear cover plate viewed from the front thereof, showing the interior front surface of the cover plate;

FIG. 6 is a fragmentary horizontal section view, to enlarged scale, through the plastic insert closure button and immediately adjacent portions of the rear cover plate and of the drive cam and drive spindle and spline key; and FIG. 7 is a front elevation view of the closure button insert.

DETAILED DESCRIPTION OF A PREFERRED EMBODIMENT

Figure 1:
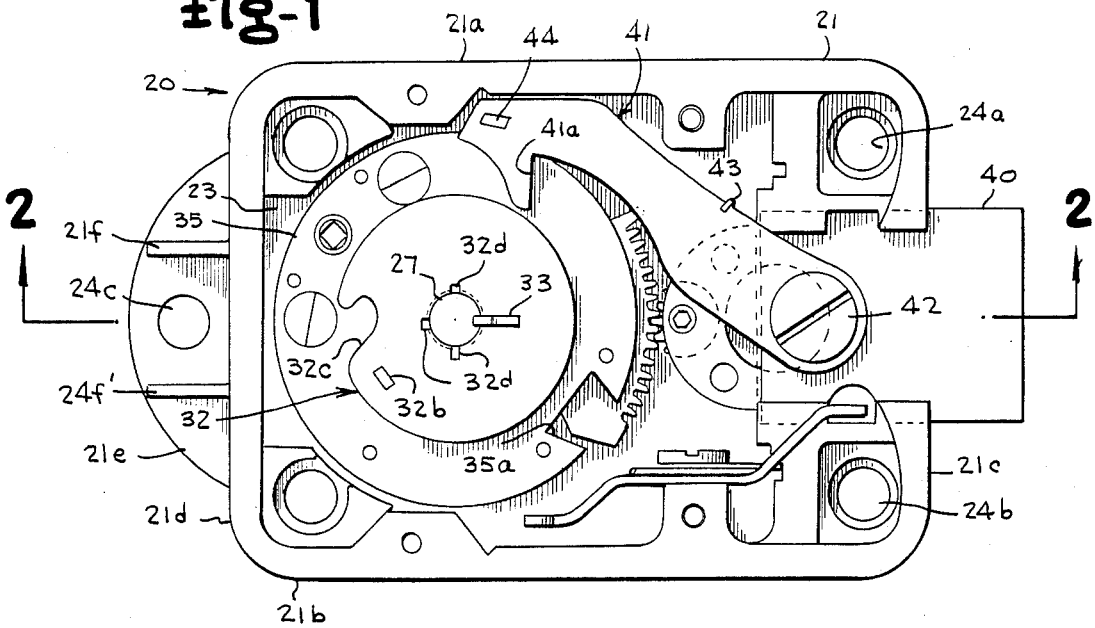
FIG. 1 is a rear elevation view of a combination lock embodying the present invention, with the rear cover removed, showing the lock in locked condition.
Figure 2:
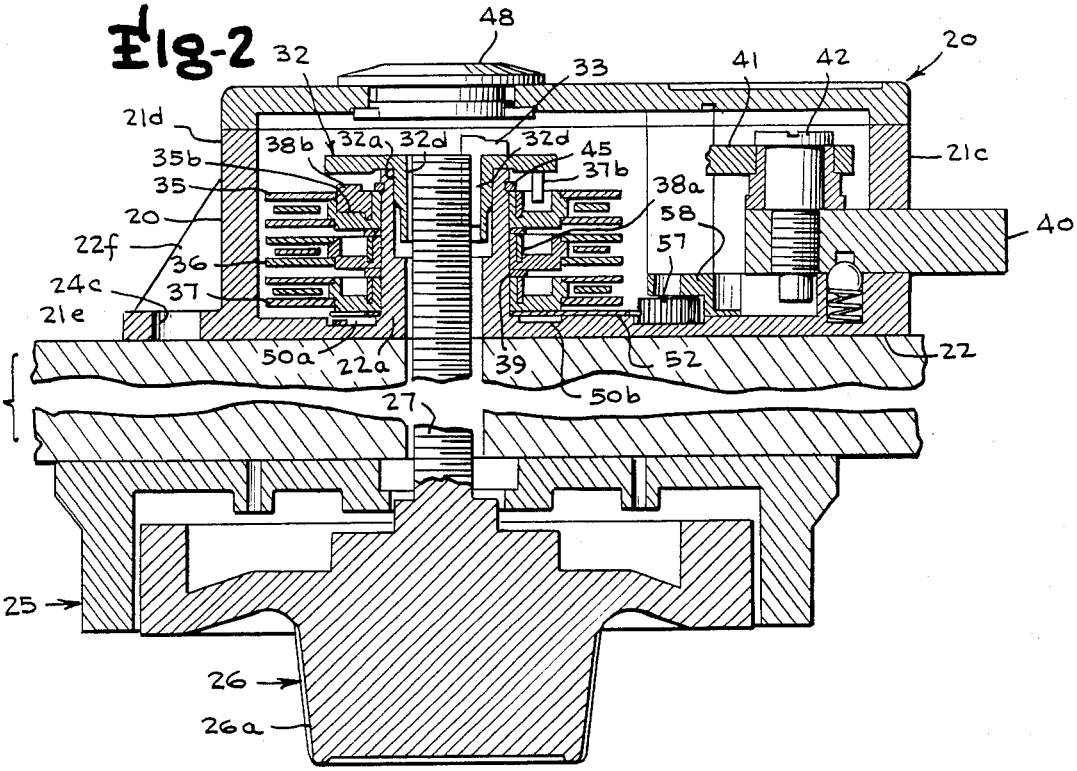
FIG. 2 is a horizontal section view of the combination lock, taken along the line 2—2 of FIG. 1.

Referring to the drawings, wherein like reference characters designate corresponding parts throughout the several figures, there is illustrated a combination lock generally indicated by the reference character 20, which is of the general type disclosed in the prior U.S. Pat. Nos. 2,275,674 and 2,807,954 issued to Harry C. Miller, or U.S. Pat. No. 3,968,667 issued to Klaus W. Gartner, all assigned to Sargent & Greenleaf, Inc., but which may optionally employ a normal drive cam as illustrated herein without special compromise-resisting features, rather than providing drive cams having guard mechanisms as disclosed in those earlier patents. While the specific embodiment of the invention hereinafter described involves application of the quick mounting externally accessible mounting screws and the removable cover insert feature to combination locks of the type shown in FIGS. 1 and 2 having three tumbler wheels and a pivoted fence lever of the configuration shown, it is to be understood that the present invention is applicable to all types of combination locks.

The combination lock comprises a substantially rectangular lock case 21 having top, bottom and end walls 21*a*, 21*b*, 21*c*, and 21*d*, and a hollow boss or tumbler post 22*a* projecting rearwardly from the front wall 22 thereof. A removable rear cover plate 23 of special construction is provided to close the rear of the lock case 21. The lock case 21 is designed to be mounted against the inner surface of a door or other closure by three mounting screws 24, two of which extend through screw holes near the corners of the lock case and adjacent the bolt end case end wall 21*c* into the supporting door, and the other of which extends through a hole in mounting flange 21*e* projecting from the opposite case end wall 21*d*. Thus each of the three mounting screws 24 are accessible externally of the lock case to be installed or removed. Secured to the outer face of the supporting door concentric with the axis of the tumbler posts 22*a* is a dial ring 25, here shown as having a cylindrical shield surrounding and shielding from view the major portion of the peripheral flange of the dial portion of the dial and knob member 26, the shield being interrupted by a sight opening of suitable circumferential extent.

The dial 26 is supported for rotation within the forwardly opening cylindrical well of the dial ring 25 defined by the dial shield, and includes a drive spindle 27 coupled at its outermost end to the dial and knob member 26 and extending through the hollow tubular post 22*a* on the front wall of the lock case 21 to be rotatably journaled by the tumbler post and supported at the desired position. The dial and knob member 26 has an integral knob portion 26*a* thereon which projects forwardly from the dial portion and preferably has a knurled periphery to facilitate manipulation of the dial and knob member 26.

The spindle 27 in the preferred embodiment may be assembled to the dial and knob member 26 by a coupling mechanism similar to that disclosed in prior U.S. Pat. No. 2,951,358 granted to Harry C. Miller, wherein the forward end portion of the spindle 27 is provided with a knurled cylindrical region which is driven into a central bore extending axially through a coupling bushing forming a serrated head adapted to interfit in a rearwardly facing serrated cylindrical well in the dial and knob member 26, the coupling bushing being provided with a constricted neck portion of sufficient length to accomodate the knurled end portion of the spindle 27 and having an enlarged diameter annular body portion providing an uninterrupted series of teeth to be interfitted with similar teeth along the cylindrical surface of the well so that the spindle may be assembled with the dial and knob member at various angular positions. Alternatively, the spindle may simply be a rod having a threaded exterior and a kerf extending along most of its length from the rearmost end thereof, with the forwardmost end fixed in the dial and knob member 26 in any desired manner.

The threaded rearmost end of the drive spindle 27 receives an internally threaded portion of a tubular boss formation 32*a* projecting forwardly integrally from the driving cam 32. The driving cam 32 is provided with a forwardly projecting drive pin 32*b*, a peripheral gate 32*c*, and four radial grooves 32*d* in the center bore of the drive cam spaced circumferentially 90° from each other so that the driving cam 32 may be keyed to the drive spindle 27 at any of the four angular positions by inserting a suitable spline key 33 into the proper radial groove 32*d* which is aligned radially with the longitudinal spline key and with the kerf in the spindle 27 to interlock these components against further relative rotation. This enables the driving cam-to-spindle connection to be readily set for right hand, left hand, vertical up, or vertical down lock installation.

A stack or array of a plurality of tumbler wheels, for example a three wheel stack indicated by the reference characters 35, 36 and 37, are supported to rotate freely upon the portion of the hollow boss or tumbler post 22*a* projecting rearwardly from the front wall of the lock case 21. It will be appreciated, of course, that a four wheel stack, or a stack of any other number of tumbler wheels may be used, and that the tumbler post may be carried by the rear wall or cover plate instead of the front wall, as is well known. Each of the tumbler wheels 35, 36 and 37 are of conventional type designed to be changed by means of a conventional resetting key to vary the combination of the lock, and to this end comprise an inner hub on each of which are supported a pair of annular discs having a tumbler gate or peripheral recess, such as the recess 35*a*, therein. The outer annular discs are selectively locked against rotation relative to their supporting hubs by means of conventional locking arms or levers carried by and between the pair of annular discs on each hub and engaging peripheral serrations or teeth on the hub to hold the annular discs at a selected angular position.

Conventional flies 38, consisting of annular rings 38*a* having an outwardly extending radial projection 38*b*thereon are provided between the pairs of tumblers 37–36, 36–35, and between tumbler 35 and drive cam 32, and an annular spacer washer 39, for example having an inner diameter conforming to the outer diameter of the tubular post 22*a* and having a pair of inwardly projecting lugs extending in to grooves on the post to prevent its rotation, is provided between each tumbler wheel pair. In the illustrated embodiment, the ring portion 38*a* of each fly may be disposed in a rearwardly facing annular groove, such as groove 35*b*, journaled on the cylindrical surface defining the radially innermost wall of the groove, with the radial projection 38*b* also lying in the groove 35*b* and being of sufficient thickness to project rearwardly into the path of the forwardly projecting drive pin 32*b* on the drive cam. The outermost cylindrical wall of the groove 35*b* is interrupted by a radially outwardly extending cut providing a well of about 20 degrees circumferentially defining stop shoulders flanking the space occupied by the radial lug 38*b* in the path of the radial lug to limit the rotation of the fly to about 20 degrees. This provides the lost motion coupling between the drive cam 32 and the rearmost tumbler 35. The flies associated with the other tumbler wheels 36 and 37 are similarly constructed and disposed in rearwardly facing grooves in those tumblers to provide lost motion couplings co-acting with forwardly projecting drive lugs on the tumbler wheels 35 and 36.

The lock is also provided with the usual bolt 40 which is adapted to slide in a suitable guide way formed in the end wall 21*c* of the lock case 21. The bolt 40 is operated by means of a fence lever 41 which is pivotally attached to the bolt by means of a screw 42. The fence lever 41 is normally resiliently urged to the elevated position illustrated in FIG. 1 by the lever spring 43 having, for example, one leg abutting the fence lever 41 and another leg abutting a stationary surface portion of the lock casing to resiliently urge the fence lever to rotate to the raised position. The fence lever 41 is provided with a laterally projecting bar 44, commonly referred to as a fence, which projects along an axis parallel to the axis of the drive spindle 27 and overlies the peripheries of all of the tumbler wheels 35, 36 and 37. The fence 44 is adapted to be received in the peripheral gates, such as gate 35*a*, of the tumbler wheels when the tumbler gates are disposed in registry with each other at a chosen angular position upon operation of the dial and knob member 26 to the proper opening combination for the lock. When the dial and knob member 26 is rotated in a predetermined manner to bring the zero mark on the dial to a lock opening position, the consequent downward movement of the fence lever 41 causes the fence 44 to enter the peripheral gates of the three tumbler wheels as the fence lever nose descends into the gate of the drive cam, when disposed at the proper angular positions, and the free end of the fence lever 41 is cammed downwardly by or descends below the depending abutment shoulder formation 21*a*′ on the upper wall 21*a* of the lock case, and the fence lever 41 may be then shifted laterally to the left of the formation 21*a*′, as viewed in FIG. 1, to withdraw the bolt 40 from its projected or locking position.

The drive cam gate 32*c* is adapted to receive the nose formation 41*b* of the fence lever 41. As will be observed from the illustration of the drive cam 32 in FIG. 1, the driving cam gate 32*c* has a pair of carefully shaped walls, one forming an inclined slightly convex wall portion for controlling the movement of the fence lever nose 41*b* into the driving cam gate and thereafter controlling the speed of approach of the fence 44 toward the peripheries of the tumbler wheels, and the other wall forming a shoulder for cooperating with a complimentary shoulder on the fence lever nose 41*b* to cause the fence lever to be shifted in a manner to retract the bolt 40 upon rotation of the drive cam in a clockwise direction as viewed in FIG. 1.

It will be appreciated that the stack of tumbler wheels, with their associated flies 38 and the spacer washers 39, may be retained on the tumbler post 22*a* in the usual manner, by providing a circular outwardly opening groove in a plane perpendicular to the axis of the tumbler post near the rearmost end of the tumbler post, in addition to the two diametrically opposite longitudinal grooves paralleling the tumbler post axis for receiving the spacer washer lugs, and removably locating a split ring or spiral spring ring 45 in the circular groove in the tumbler post bearing against the rearwardly facing edge of the rearmost tumbler or against another washer, if desired, bearing against the rearmost tumbler.

As will be observed from FIGS. 1 and 3–5, the hole pattern for the mounting screws 24 for this lock is somewhat different from the conventional mounting screw hole pattern for combination lock cases, in that, instead of providing holes for the mounting screws in the four corners of the case, to which access can be had only when the rear cover plate 20 is removed, only two such mounting screw holes, indicated at 24*a* and 24*b*, need be provided in the case, and similar holes are also provided through corresponding portions of the rear cover plate 20, indicated at 24*a*′, 24*b*′, adjacent the end wall 24*c* of the case through which the bolt 40 projects. The mounting flange 21*e* is provided integrally with the lock case 21 to extend from the end wall 21*d* thereof, projecting in a plane flush with the plane of the front wall 22 of the lock case and in the illustrated embodiment has a convex arcuately curved or almost semicircular profile. This mounting flange 21*e* is also provided with a mounting screw hole 24*c* for the third mounting screw 24 to pass therethrough into the door or other closure wall, and the mounting flange 21*e* is strengthened or reinforced in the region of the mounting screw hole 24*c* by a pair of triangular gusset formations 21*f*, 21*f*′ flanking the mounting screw hole 24*c*. While the mounting flange 21*e* is illustrated as having a convex arcuately curved configuration, it will be appreciated that the flange may assume other configurations, such as triangular, trapezoidal, or semicircular, or could if desired have a substantially rectangular profile. By this arrangement, the three mounting screws 24 are always accessible from the rear of the lock when the lock case 21 and rear cover plate 23 are assembled in lock case closing condition, thus permitting ready access to the mounting screw arrangement by lock installers, manufacturers and the like without having to open the lock case by removal of the rear cover plate.

Also, as will be apparent from the Figures, the rear cover plate 23 is provided with a circular access opening 45 concentrically aligned with the extended axis of the dial spindle 27 rearwardly of the rearmost end of the dial spindle and of the path of rotation of the rearmost portion of the spline key 33 which locks the driving cam 32 in the desired angular position relative to the dial spindle 27. This access opening 45 is of slightly larger diameter than the diameter of the path traversed by the rear portion of the spline key 33 when it rotates with the drive cam 32 and dial spindle 27, and the access opening 45 is interrupted by two diametrically opposite radially outwardly extending rectangular channels or slots 46, shown aligned vertically with the access opening 45 in FIG. 5, to receive diametrically oppositely projecting retaining tongues or lugs 47 projecting radially from the peripheral wall of the removable plastic insert closure button 48 which normally closes the access opening 45 in the rear cover plate 23. Displaced circumferentially 90° from the channels or slots 45 are radially outwardly extending undercut recesses 49 formed in the inner surface or front surface of the cover plate 23 to extend only partially through the thickness of the cover plate, forming detenting recesses to receive the retaining tongues or lugs 47 of the insert 48 when the insert has been fitted into position to locate its retaining tongues or lugs immediately inwardly of the front surface of the front cover plate 23 followed by rotation of the insert 48 through 90° to register with the detenting recesses 49.

As shown in FIG. 6, the plastic insert closure button 48 has a diametrically extending elongated slot-like groove in the midportion of its rearwardly facing surface 48*a* to receive a narrow bit or rib formation such as usually is present on a combination change key, or to receive the blade of a screwdriver or similar tool, to facilitate rotation of the insert 48 between detented position aligning the tongues or lugs 47 with the detent recesses 49 and release position aligning the tongues 47 with the channels or slots 46. With this removable closure insert 48 rearwardly aligned with the dial spindle 27 and the path or rotation of the rear portion of the spline key 33, the hand or angular position of the drive cam 32 relative to the dial spindle 27 can be readily changed between the right hand, left hand, vertical up, or vertical down positions without having to remove the rear cover plate 23, by simply removing the closure button 48, withdrawing the spline key 33 from the kerf in the spindle 47 and the aligned radial groove 32*d* of the driving cam, whereupon the dial and spindle 27 can be rotated relative to the drive cam 32 to different angular positions to align the spindle kerf with others of the radial grooves 32*d* in the driving cam as desired, and the spline key 33 reinserted to connect the drive cam to the spindle at the desired angular position.

I claim:

1. A quick mount combination lock constructed to be readily installed or changed to assume any of the four right hand, left hand, vertical up, or vertical down installation positions from externally of the lock case, the lock comprising a front case section having front, side, end, top and bottom walls defining a rearwardly opening substantially rectangular enclosure and a rear cover plate substantially coextensive with said front wall to be removably assembled on the front section and form a closure therefor providing a lock mechanism chamber, a combination lock mechanism including a plurality of peripherally gated tumbler wheels rotatably journaled about a common axis, means for adjusting the angular positions of the tumbler wheels through lost motion couplings including a dial having a drive spindle extending along said axis therefrom and a drive cam adjustably positioned on said spindle by a spline key at any of four angular positions correlated to said installation positions, a fence lever pivoted on a reciprocative bolt slidable through one end wall of the case, the fence lever being movable by the drive cam along an unlocking path when coupled thereto to retract the bolt; said front case section having an integral flange extension lying in the plane of said front wall and protruding from a second end wall thereof opposite said one end wall and having a mounting screw opening therethrough, said front case section and cover plate having aligned mounting screw holes extending entirely therethrough adjacent said second end wall whereby the mounting screws for securing the lock case to the security closure to which it is to be affixed are accessible for installation and withdrawal without removing the cover plate from said front case section, and said cover plate having an access opening therethrough concentric with said common axis located rearwardly adjacent the rearmost end of the spindle for removal and installation of the spline key releasably retaining the driving cam in any of said four angular positions on the spindle, and a removable closure button member releasably secured in said access opening.

2. A quick mount combination lock as defined in claim 1, wherein said integral flange extension has a protruding mid-zone including said mounting screw opening with the edge of said mid-zone spaced further from said second end wall than the edge of the remaining portions of the flange extension and said mid-zone being substantially equidistant from said top and bottom walls.

3. A quick mount combination lock as defined in claim 1, wherein said integral flange extension is of convex arcuate profile in rear elevation extending from said second end wall of the front case section and is of the same thickness as said front wall section.

4. A quick mount combination lock as defined in claim 1, including a pair of right triangular gussets joined integrally with and extending from said second end wall and a rearwardly facing surface of said flange extension.

5. A quick mount combination lock as defined in claim 1, including a pair of right triangular gussets joined integrally with and extending from said second end wall and a rearwardly facing surface of said flange extension and are disposed in flanking relation to said mounting screw opening located to opposite sides thereof, the mounting screw opening being substantially aligned with a horizontal center line of the lock case located equidistant from said top and bottom walls.

6. A quick mount combination lock as defined in claim 2, including a pair of right triangular gussets joined integrally with and extending from said second end wall and a rearwardly facing surface of said flange extension.

7. A quick mount combination lock as defined in claim 2, including a pair of right triangular gussets joined integrally with and extending from said second end wall and a rearwardly facing surface of said flange extension and are disposed in flanking relation to said mounting screw opening located to opposite sides thereof, the mounting screw opening being substantially aligned with a horizontal center line of the lock case located equidistant from said top and bottom walls.

8. A quick mount combination lock as defined in claim 3, including a pair of right triangular gussets joined integrally with and extending from said opposite end wall and a rearwardly facing surface of said flange extension.

9. A quick mount combination lock as defined in claim 3, including a pair of right triangular gussets joined integrally with and extending from said second end wall and a rearwardly facing surface of said flange extension and are disposed in flanking relation to said mounting screw opening located to opposite sides thereof, the mounting screw opening being substantially aligned with a horizontal center line of the lock case located equidistant from said top and bottom walls.

10. A quick mount combination lock as defined in claim 1, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

11. A quick mount combination lock as defined in claim 2, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

12. A quick mount combination lock as defined in claim 3, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

13. A quick mount combination lock as defined in claim 4, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

14. A quick mount combination lock as defined in claim 5, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

15. A quick mount combination lock as defined in claim 6, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

16. A quick mount combination lock as defined in claim 7, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

17. A quick mount combination lock as defined in claim 8, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

18. A quick mount combination lock as defined in claim 9, wherein said rear cover plate includes a pair of diametrically opposite channel-shaped slots extending entirely therethrough projecting radially outwardly from the circular boundary of said access opening and having a pair of forwardly opening diametrically opposite detent recesses in the front surface of said rear cover plate circumferentially spaced from said slots, and said closure button member having radially outwardly projecting locking lug formations at the forwardmost portion thereof sized to interfit in and pass through said channel-shaped slots and to be releasably seated in said detent recesses upon appropriate rotation of said button member.

* * * * *